US008282750B1

(12) United States Patent
Rambow et al.

(10) Patent No.: US 8,282,750 B1
(45) Date of Patent: Oct. 9, 2012

(54) GAS GENERANT WITH AUTO-IGNITION FUNCTION

(75) Inventors: Scott M. Rambow, Roseville, MI (US); Deborah L. Hordos, Troy, MI (US)

(73) Assignee: TK Holdings, Inc., Armada, MI (US)

( * ) Notice: Subject to any disclaimer, the term of this patent is extended or adjusted under 35 U.S.C. 154(b) by 158 days.

(21) Appl. No.: 12/925,931

(22) Filed: Nov. 1, 2010

Related U.S. Application Data

(60) Provisional application No. 61/280,296, filed on Oct. 31, 2009.

(51) Int. Cl.
*C06B 31/28* (2006.01)
*C06B 29/02* (2006.01)

(52) U.S. Cl. ..... 149/46; 149/77

(58) Field of Classification Search ..... 149/45, 149/46, 77
See application file for complete search history.

(56) References Cited

U.S. PATENT DOCUMENTS 6,132,537 A * 10/2000 Zeuner et al. ..... 149/45
7,335,270 B2 * 2/2008 Serizawa et al. ..... 149/76

* cited by examiner

*Primary Examiner* — Aileen B Felton
(74) *Attorney, Agent, or Firm* — L.C. Begin & Associates, PLLC.

(57) ABSTRACT

Gas generating compositions include a combination of melamine and maleic hydrazide as a primary fuel; and a primary oxidizer consisting of ammonium nitrate and potassium chlorate. Gas generators and vehicle occupant protection systems incorporating the present compositions are also described.

8 Claims, 1 Drawing Sheet

GAS GENERANT WITH AUTO-IGNITION FUNCTION

CROSS-REFERENCE TO RELATED APPLICATIONS

This application claims the benefit of U.S. Provisional Application Ser. No. 61/280,296 filed on Oct. 31, 2009.

TECHNICAL FIELD

The present invention relates generally to gas generating systems, and to gas generating compositions employed in gas generator devices for automotive restraint systems, for example.

BACKGROUND OF THE INVENTION

The present invention relates to gas generant compositions that upon combustion produce a relatively smaller amount of solids and a relatively abundant amount of gas. It is an ongoing challenge to reduce the amount of solids and increase the amount of gas thereby decreasing the filtration requirements for an inflator. As a result, the filter may be either reduced in size or eliminated altogether thereby reducing the weight and/or size of the inflator. Additionally, reduction of combustion solids provides relatively greater amounts of gaseous products per gram or unit of gas generating composition. Accordingly, less gas generant is required when greater mols of gas are produced per gram of gas generant. The result is typically a smaller and less expensive inflator due to reduced manufacturing complexity.

Yet another concern is that the compositions that contain ammonium nitrate, an acceptable oxidizer for low solid or "smokeless" gas generants, must exhibit burn rates that are satisfactory with regard to use in vehicle occupant protection systems. Furthermore, the compositions containing ammonium nitrate must retain their physical integrity. It is known that ammonium nitrate when cycled through various temperature regimes undergoes phase changes that contribute to an unstable propellant tablet that may in fact fracture because of the changes in phase of ammonium nitrate. As a result, ongoing efforts utilize various methods and additives that when combined with ammonium nitrate, attenuate or altogether eliminate the phase changes of ammonium nitrate. Phase stabilized ammonium nitrate (PSAN) incorporating co-precipitated potassium nitrate is one example. The ammonium nitrate must nevertheless be processed with potassium nitrate or some other stabilizing agent thereby resulting in a phase stabilized ammonium nitrate. Even with the use of potassium nitrate to stabilize ammonium nitrate, modest phase changes are still apparent when evaluating ammonium nitrate stabilized with potassium nitrate. To ensure dimensional stability of gas generating pellets containing PSAN, for example, it is therefore an ongoing effort to improve the phase stability of compositions that contain ammonium nitrate.

Thermal stability is yet another concern with compositions containing phase stabilized ammonium nitrate and a primary fuel. When heat-aged at 107C. for about 400 hours, many compositions are not thermally stable due to decomposition. The related performance concerns include ballistic performance and control.

SUMMARY OF THE INVENTION

Gas generating compositions include a combination of melamine and maleic hydrazide as a primary fuel; and a primary oxidizer consisting of ammonium nitrate and potassium chlorate. Gas generators and vehicle occupant protection systems incorporating the present compositions are also described.

DETAILED DESCRIPTION OF THE INVENTION

Figure 1:
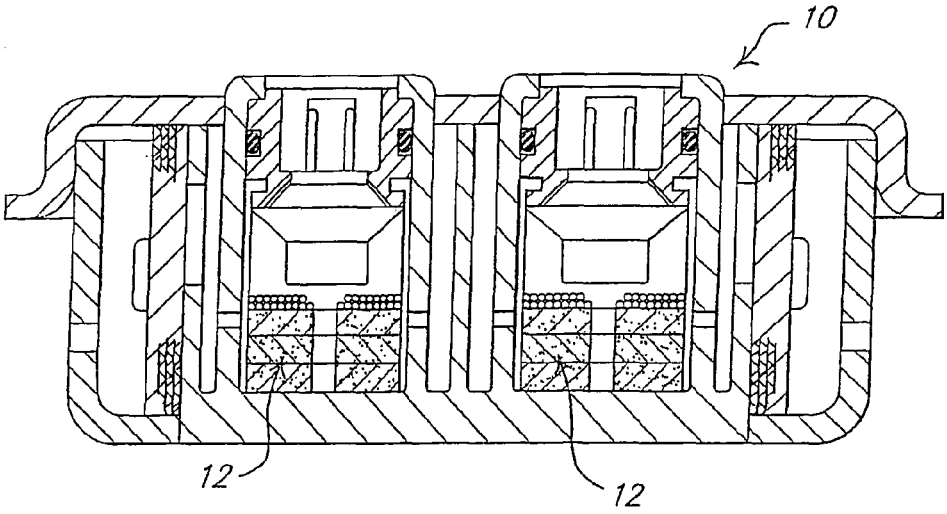
FIG. 1 is a cross-sectional side view showing the general structure of an inflator in accordance with the present invention.

The above-referenced concerns are resolved by gas generators or gas generating systems containing novel fuel constituents within novel auto-igniting gas generant compositions.

In one composition or embodiment, the oxidizer constituent is ammonium nitrate and potassium chlorate. A preferred weight ratio of ammonium nitrate to potassium chlorate is about 5.9:1.0. This preferred ratio may be modified from about 5.9:1.5 to about 6.5:1.0. In the same composition, the primary fuel constituent is melamine and maleic hydrazide. A preferred molar ratio of melamine to maleic hydrazide is about 1:0:1.0, although the melamine content may be increased with satisfactory stability. The fuel range is about 5-40 weight percent melamine and 0-35 weight percent maleic hydrazide. The preferred ratio of oxidizer to fuel is about 60-85 weight percent oxidizer to about 15-40 weight percent fuel.

Perchlorate salts may also be utilized as part of the oxidizing constituent and include alkali and alkaline earth perchlorate salts. Other sources of potassium such as potassium nitrate may also be used as an oxidizer.

A high temperature (about 100C.) wet mixture of phase stabilized ammonium nitrate, melamine, and maleic hydrazide is blended and dried at a high temperature, each constituent provided in the amounts provided above.

The compositions of the present invention are formed from constituents as provided by known suppliers such as Aldrich or Fisher Chemical companies. The compositions may be mixed and then molded in a known manner, or otherwise mixed and manufactured as known in the art. The compositions may be employed in gas generators typically found in airbag devices or occupant protection systems, or in safety belt devices, or in gas generating systems such as a vehicle occupant protection system, all manufactured as known in the art, or as appreciated by one of ordinary skill.

The compositions of the present invention may be provided in the indicated amounts, wet-mixed, and then co-precipitated in a known manner. The following examples illustrate how providing potassium in different forms affects the phase stability of the resultant phase stabilized ammonium nitrate.

EXAMPLES

Example 1

A composition blended in accordance with the present invention contains PSAN (stabilized with at least 10% of potassium perchlorate), melamine, and maleic hydrazide in the amounts described above. When evaluated by Differential Scanning calorimetry (DSC), the composition exhibited a plurality of modest phase changes between 110C. and 140C.; auto-ignition began at over 210C.

Example 2

A composition blended in accordance with the present invention contains PSAN (stabilized with at least 10% of potassium nitrate), melamine, and maleic hydrazide in the amounts described above. When evaluated by Differential Scanning calorimetry, the composition exhibited a plurality of modest phase changes between 115C. and 140C.; auto-ignition began at over 210C.

Example 3

A composition blended in accordance with the present invention contains PSAN (stabilized with at least 10% of potassium chlorate), melamine, and maleic hydrazide in the amounts described above. When evaluated by Differential Scanning calorimetry, the composition exhibited no phase changes prior to auto-ignition beginning at about 158C.

Examples 4-9

Five compositions blended in accordance with the present invention respectively contain by weight percent 81.8:18.2 AN:KC; 84.3:15.7 AN:KC; 85.5:14.5 AN:KC; 86.8:13.2 AN:KC; and 89.3:10.7 AN:KC, wherein AN is ammonium nitrate and KC is potassium chlorate, such that AN and KC are co-precipitated to form PSAN. Melamine and Maleic Hydrazide were also wet-mixed or dry-mixed with the AN and KC in these compositions, to form substantially uniform mixtures and compositions. The compositions were evaluated by Differential Scanning calorimetry and found to have little if any phase changes prior to auto-ignition at about 155C. to 160C.

Example 10

One composition blended in accordance with the present invention contains by weight percent 90:10 AN:KN where AN is ammonium nitrate and KN is potassium nitrate, wherein AN and KN are co-precipitated to form PSAN. Melamine and Maleic Hydrazide were also wet-mixed or dry-mixed with the AN and KN in this composition, to form a substantially uniform mixture and composition. The compositions was evaluated by Differential Scanning calorimetry and found to have substantial phase changes at about 108-120C. and 128-130C.

Example 11

One composition blended in accordance with the present invention contains ammonium nitrate, potassium chlorate, and maleic hydrazide, in the amounts indicated above. Based on DSC analysis, a slight phase change occurred at about 110C. It is believed that the maleic hydrazide accounted for a relatively low auto-ignition temperature at about 155C.

Example 12

One composition contained ammonium nitrate co-precipitated with about 10% potassium chlorate, the percent taken of the total weight of the composition. Based on DSC analysis, several phase changes occurred between 105C. to 130C., with no auto-ignition below 160C. As indicated in the examples herein, it can be seen that the addition of melamine to PSAN stabilized with KC eliminates the phase changes that are typically found in PSAN.

Example 13

One composition contained ammonium nitrate co-precipitated with potassium chlorate in accordance with the present invention to form PSAN. Melamine was also mixed with the PSAN in amounts indicated above. Based on DSC analysis, no phase changes occurred prior to the onset of auto-ignition beginning at about 162C. and peaking at about 185C. When compared to Examples 4-9 and 11, it can be seen that combining maleic hydrazide and melamine with PSAN stabilized by potassium chlorate results in a reduced auto-ignition temperature onset, with no phase changes prior to the onset of auto-ignition.

Example 14

Further to Example 13, various compositions were formulated in accordance with the present invention, all containing PSAN stabilized with potassium chlorate. The fuels of each composition were respectfully all maleic hydrazide in the first composition; one part melamine and one part maleic hydrazide in the second composition; three parts melamine to one part maleic hydrazide in the third composition; five parts melamine to one part maleic hydrazide in the fourth composition; and all melamine in the fifth composition. As determined by DSC analysis, respective auto-ignition temperatures for compositions one through five were indicated as 149.93C., 159.63C., 165.49C., 168.52C., and 187.49C. As also indicated, phase changes occurred in the first composition, but in none of compositions two through five.

Example 15

A composition formed as provided in Example 3 was heat aged at 107C. for about 336 hours. When compared to an equivalent composition not so heat aged, there was no indication of weight loss, but there was a slight decrease in auto-ignition temperature, from a 183.72C. peak of the non-heat aged sample to a 176.74C. peak of the heat-aged sample.

Example 16

It should further be appreciated that impact sensitivity was generally improved when comparing compositions of the present invention to similar compositions, whereas a composition formed in accordance with Example 3 exhibited an impact sensitivity of 14.5 inches when evaluated by the Bruceton Test.

Example 17

It should further be appreciated that friction sensitivity was generally improved when comparing compositions of the present invention to similar compositions, whereas a composition formed in accordance with Example 3 exhibited insensitivity to friction up to 360 Newtons as per the BAM friction test.

As shown in FIG. 1, an exemplary inflator or gas generating system 10 incorporates a dual chamber design to tailor containing a primary gas generating composition 12 formed as described herein, may be manufactured as known in the art. U.S. Pat. Nos. 6,422,601, 6,805,377, 6,659,500, 6,749,219, and 6,752,421 exemplify typical airbag inflator designs and are each incorporated herein by reference in their entirety.

Figure 2:
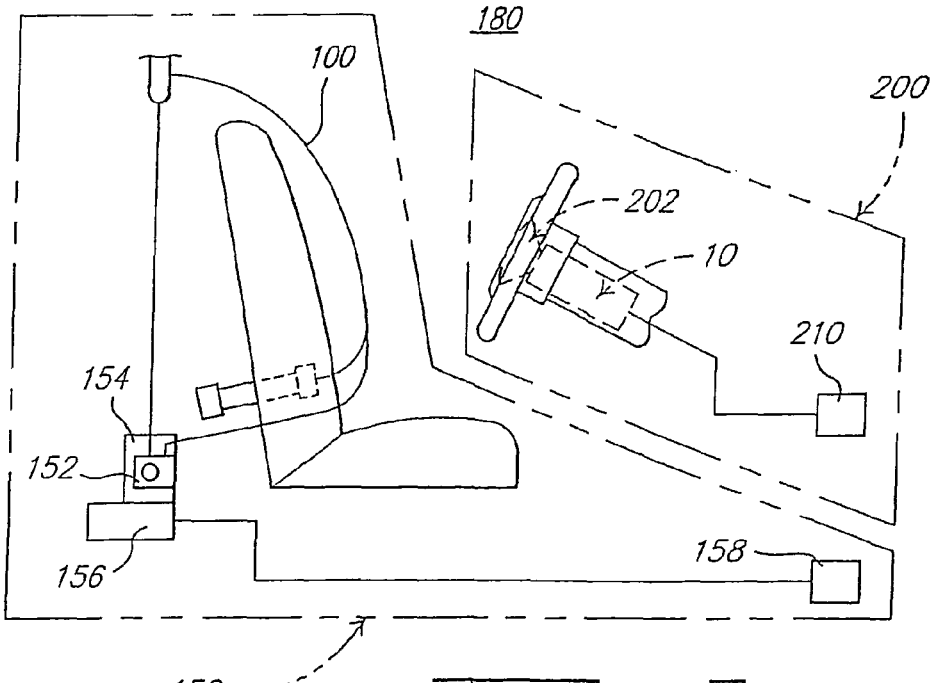
FIG. 2 is a schematic representation of an exemplary vehicle occupant restraint system containing a gas generant composition in accordance with the present invention.

Referring now to FIG. 2, the exemplary inflator or gas generating system 10 described above may also be incorporated into an airbag system 200. Airbag system 200 includes at least one airbag 202 and an inflator 10 containing a gas generant composition 12 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 2, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing gas generating/auto ignition composition 12 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

It should further be understood that the preceding is merely a detailed description of various embodiments of this invention and that numerous changes to the disclosed embodiments can be made in accordance with the disclosure herein without departing from the scope of the invention. The preceding description, therefore, is not meant to limit the scope of the invention.

What is claimed is:

1. A composition comprising:

a primary fuel consisting of a combination of melamine and maleic hydrazide; and a primary oxidizer consisting of ammonium nitrate and potassium chlorate.

2. The composition of claim 1 wherein said primary fuel has a ratio of one part of melamine to one part of maleic hydrazide.

3. The composition of claim 1 wherein said primary oxidizer has a ratio of about 5.9 to 6.5 parts of ammonium nitrate for every 1.5 to one part of potassium chlorate.

4. The composition of claim 1 wherein said primary fuel is about 15-40 weight percent and said primary oxidizer is about 60-85 weight percent, said percents taken by weight of the total composition.

5. The composition of claim 1 wherein said ammonium nitrate and potassium chlorate are wet-mixed with melamine and maleic hydrazide, and then dried and co-precipitated to form said composition.

6. A composition comprising:

a primary fuel consisting of a combination of melamine and maleic hydrazide, said primary fuel provided at about 15-40 weight percent of the total composition; and a primary oxidizer consisting of phase stabilized ammonium nitrate stabilized with potassium chlorate, said primary oxidizer provided at about 60-85 weight percent of the total composition.

7. A gas generator containing the composition of claim 6.

8. A vehicle occupant protection system containing the composition of claim 6.

* * * * *

UNITED STATES PATENT AND TRADEMARK OFFICE

CERTIFICATE OF CORRECTION

PATENT NO. : 8,282,750 B1
APPLICATION NO. : 12/925931
DATED : October 9, 2012
INVENTOR(S) : Rambow et al.

It is certified that error appears in the above-identified patent and that said Letters Patent is hereby corrected as shown below:

Col. 2, Example 1, Line 67; Delete “calorimetry” and Insert --Calorimetry--.

Col. 3, Example 2, Line 10; Delete “calorimetry” and Insert --Calorimetry--.

Col. 3, Example 3, Line 20; Delete “calorimetry” and Insert --Calorimetry--.

Col. 3, Example 4-9, Line 35; Delete “calorimetry” and Insert --Calorimetry--.

Col. 3, Example 10, Line 48; Delete “calorimetry” and Insert --Calorimetry--.

Signed and Sealed this
Eighteenth Day of December, 2012

David J. Kappos

David J. Kappos
*Director of the United States Patent and Trademark Office*